US007341246B2

(12) United States Patent
Donohue

(10) Patent No.: US 7,341,246 B2
(45) Date of Patent: Mar. 11, 2008

(54) TRUSS MANUFACTURING APPARATUS

(75) Inventor: Thomas Joseph Donohue, Hope Island Resort (AU)

(73) Assignee: Australian Timber and Trusses Pty Ltd, Queensland (AU)

( * ) Notice: Subject to any disclaimer, the term of this patent is extended or adjusted under 35 U.S.C. 154(b) by 340 days.

(21) Appl. No.: 10/884,434

(22) Filed: Jul. 2, 2004

(65) Prior Publication Data

US 2005/0011375 A1 Jan. 20, 2005

(30) Foreign Application Priority Data

Jul. 2, 2003 (AU) ..... 2003206432

(51) Int. Cl.
*B25B 1/20* (2006.01)

(52) U.S. Cl. ..... 269/37; 269/910; 100/913

(58) Field of Classification Search ..... 269/37, 269/910, 303–305; 100/100, 913, 295; 29/559, 29/281.1, 561, 563
See application file for complete search history.

(56) References Cited

U.S. PATENT DOCUMENTS 4,426,059 A * 1/1984 Mort ..... 248/637
4,627,564 A * 12/1986 Bowser ..... 227/152
5,095,605 A * 3/1992 Tonus ..... 29/432
5,617,622 A * 4/1997 Anderson ..... 29/281.3
6,702,269 B1 * 3/2004 Tadich ..... 269/37
6,978,987 B2 * 12/2005 Kanjee ..... 269/37
7,003,865 B1 * 2/2006 Blevio, Sr. ..... 29/561

* cited by examiner

*Primary Examiner*—Lee D Wilson
(74) *Attorney, Agent, or Firm*—Abelman, Frayne & Schwab

(57) ABSTRACT

The machine has stopper pins for locating two or more truss members to be connected in respective predetermined design positions and a press head adapted for movement from a pre-pressing position in which one or two nail plates may be loaded for pressing to a range of pressing positions in which the nail plates may be pressed into engagement with adjacent truss members in a predetermined securing position by reference to an outside edge of one of the truss members. Securing mechanism on the press head are adapted to secure different sized magazines, each magazine being adapted to hold a plurality of nail plates of a predetermined size. The securing mechanism is adapted to secure each sized magazine in a position in which a selected edge of a nail plate is in a predetermined loading position irrespective of the magazine selected.

18 Claims, 7 Drawing Sheets

TRUSS MANUFACTURING APPARATUS

This invention relates to truss manufacturing apparatus. The invention has particular application to timber trusses of the type having a plurality of timber members connected by steel nail plates. However, the invention may be used for the manufacture of other types of structures such as timber wall frames. Further, the invention may have application to structures made from other types of material.

The invention is aimed at providing truss manufacturing apparatus and machines for use in such apparatus which are more efficient than the presently available apparatus.

With the foregoing in view, the invention in one aspect resides broadly in truss manufacturing apparatus for use in manufacturing timber trusses, including:

a plurality of nail plate pressing machines arranged for relative movement to each other in a horizontal plane, each nail plate pressing machine having a press head adapted to press a nail plate into engagement with two or more adjacent truss members in a predetermined securing position;

characterised in that said predetermined securing position is determined by reference to the outside edge position of one of the truss members into which the nail plate is to be pressed or the assumed position of the outside edge according to a computerised truss design.

In another aspect the invention resides broadly in a nail plate pressing machine for use in manufacturing timber trusses and adapted to travel in a horizontal plane to a selected machine position, including:

locating means for locating two or more truss members to be connected in respective predetermined design positions;

a press head adapted for movement to a range of pressing positions for pressing a nail plate into engagement with the two or more adjacent truss members in a predetermined securing position;

drive means for driving said press head to a selected pressing position within said range of pressing positions; and a controller for controlling movement of said press head to said selected pressing position.

Preferably, said controller is adapted to determine the predetermined pressing position relative to the predetermined securing position by reference to the outside edge of one of the truss members into which the nail plate is to be pressed or the assumed position of the outside edge. In such form it is preferred that the position or assumed position of said outside edge of one of the truss members is determined by reference to the locating means and the width of the truss member as selected by computer according to the design of the truss under construction. For that purpose the truss design data may be in any suitable form readable by the machine or a computer operatively connected to the machine.

Preferably, said drive means includes a stepper motor and a rack and pinion and that said stepper motor is controlled by reference to data relating to the truss design. Typically, the control means would read the truss design data and actuate the stepper motor to move the press head to the desired pre-pressing position so as to press the nail plate in the desired securing position.

In a preferred form said press head said press head has a first face adapted to engage with one face of the truss members to be connected and a second face spaced from said first face and adapted to engage with the other face of the truss members to be connected and said first and second faces are adapted to cooperate to press nail plates into said first and second faces of the truss members respectively. In one such form of the invention, the press head is adapted to press both nail plates into their respective positions simultaneously in one pressing operation.

In another aspect the invention resides broadly in a nail plate pressing machine for use in manufacturing timber trusses and adapted to travel in a horizontal plane to a selected position, including:

locating means for locating two or more truss members to be connected in respective predetermined design positions;

a press head adapted for movement from a pre-pressing position in which one or more nail plates may be loaded for pressing to a range of pressing positions in which the one or more loaded nail plates may be pressed into engagement with the two or more adjacent truss members in a predetermined securing position and vice versa, and securing means on said press head adapted to secure any one of a plurality of magazines within a range of magazine sizes, each magazine being adapted to hold a plurality of nail plates or a plurality of nail plate cartridges of a predetermined size respectively for loading, said securing means being adapted to secure each sized magazine in a position in which a selected edge of a nail plate or a nail plate cartridge to be loaded is in a predetermined loading position irrespective of the magazine selected;

nail plate loading means for loading a nail plate or a nail plate cartridge from said magazine;

drive means for driving said press head from said pre-pressing position to said pressing position and vice versa;

a controller for controlling movement of said press head from said pre-pressing position to said selected pressing position and vice versa; and actuating means for actuating said press head to press a loaded nail plate into engagement with the two or more truss members in the securing position.

Advantageously, when the manufacturing apparatus is programmed for a particular truss design, the magazine allows for fast and efficient manufacture of different shapes and sizes of truss. Advantageously, in one form the securing means is adapted to secure any one of a plurality of different sized magazines which themselves are adapted to hold one size or another of nail plates. In this respect it will be appreciated that different truss designs require different sized nail plates. Thus, when the machine is re-set for different truss designs the magazine can be quickly and easily replaced with a bigger or smaller one as required with the design data for the predetermined securing position of the nail plates working from the same edge position as for a previous truss of different design. Advantageously, the pusher is adapted to cooperate with any one of a plurality of different sized magazines adapted to hold different sized nail plates or nail plates. For this purpose, in a preferred form each magazine has two spaced apart side walls adapted to retain a stack of nail plates there between and a lip, lug or the like extending therefrom and adapted to support thereon the stack of nail plates, while the pusher is adapted to engage with the nail plate or nail plate cartridge resting against said lips or lugs and push it from said magazine. In order for the pusher to accommodate a range of magazine sizes and nail plate sizes a typical pusher is a flat steel bar having a first finger portion adapted to slide between said lips or lugs of the magazine and a pair of second finger portions spaced from said first finger portion on opposite sides thereof to form spaced apart slots. In such form the lips or lugs can slide in the slots for small magazines while for larger magazines both the first and second finger portions can slide between the lips of the spaced apart side walls.

In another aspect the invention resides broadly in truss manufacturing apparatus for use in manufacturing timber trusses, including:

a plurality of nail plate pressing machines as previously described arranged for relative movement to each other in a horizontal plane;

selecting means for selecting a desired pressing position within said range of pressing positions;

nail plate positioning means for positioning a nail plate on said press head for pressing by said press head into engagement with the two or more truss members in the selected nail plate pressing position; and control means for controlling movement of said press head into said nail plate pressing position.

In yet another aspect the invention resides broadly in truss manufacturing apparatus for use in manufacturing timber trusses, including:

a plurality of nail plate pressing machines arranged for relative movement to each other in a horizontal plane, each nail plate pressing machine having a press head adapted for movement into a range of nail plate pressing positions for pressing a nail plate into engagement with two or more truss members to secure them together;

selecting means for selecting a desired nail plate pressing position within said range of nail plate pressing positions;

nail plate positioning means for positioning a nail plate on said press head for pressing by said press head into engagement with the two or more truss members in the selected nail plate pressing position; and control means for controlling movement of said press head into said nail plate pressing position.

Preferably, said selecting means selects said desired nail plate pressing position by reference to the size of one or more of the truss members and the control means is arranged to control movement of said press head to said nail plate pressing position by reference to the position of the outside edge of one of the truss members according to the locating means which preferably defines the outside edge of one of the truss members.

In another aspect the invention resides broadly in a method of manufacturing trusses, including:

providing truss manufacturing apparatus as previously described;

loading into a computer connected to said nail plate pressing machines data relating to the design of a truss to be manufactured;

selecting a desired pressing position for each press head by reference to the data; and controlling movement of the respective press heads to the desired pressing position by reference to the data.

In another aspect the invention resides broadly in a method of connecting truss members to form a joint of a truss, including:

providing a nail plate pressing machine as previously described;

loading into a computer connected to said nail plate pressing machine data relating to the design of a truss to be manufactured;

selecting a desired pressing position for the press head by reference to the data; and controlling movement of said press head to the desired pressing position by reference to the data.

In order that the invention may be more easily understood and put into practical effect, reference will now be made to the accompanying drawings wherein.

Figure 1:
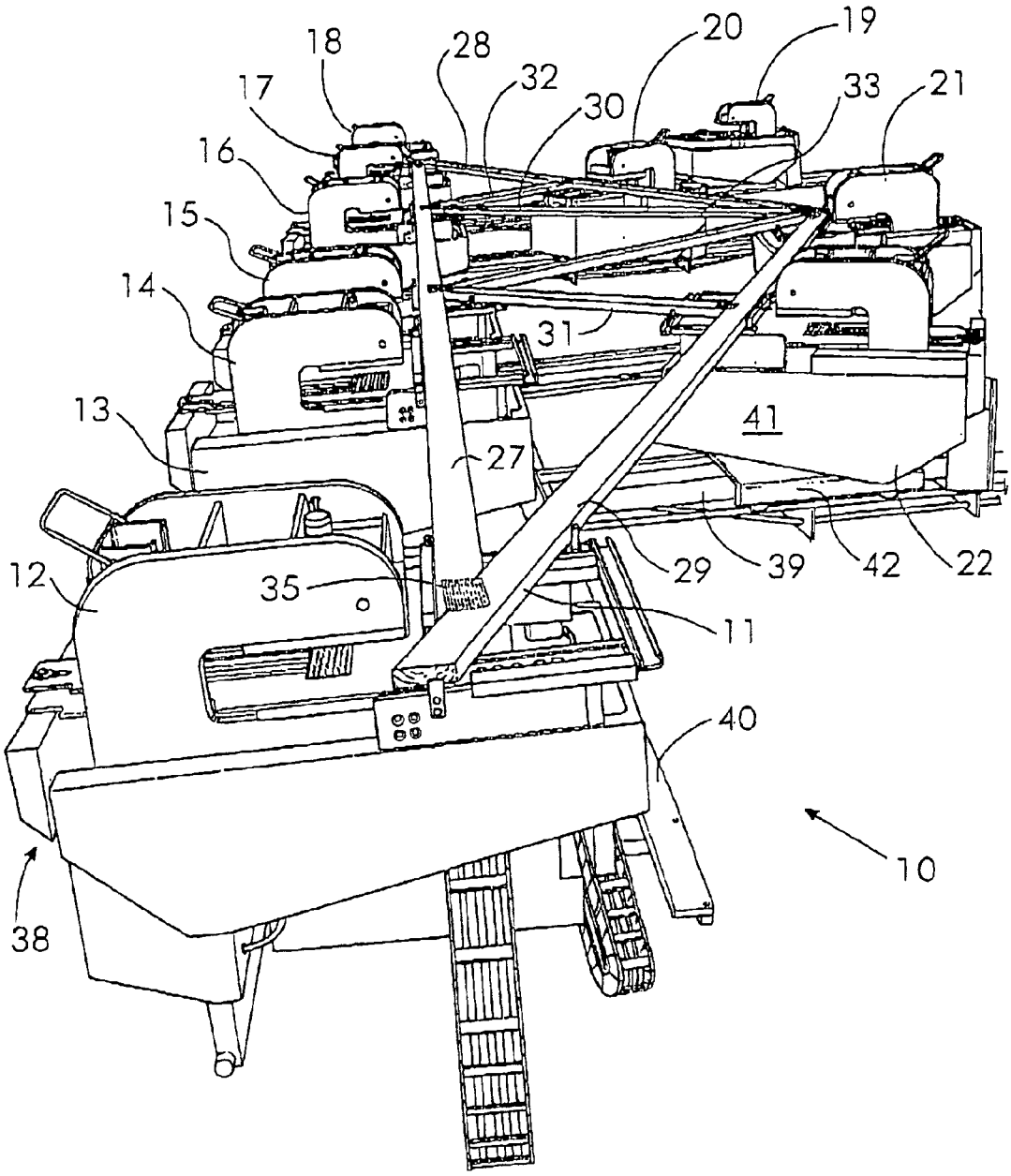
FIG. 1 is a pictorial representation of truss manufacturing apparatus according to the present invention with a truss being manufactured.
Figure 2:
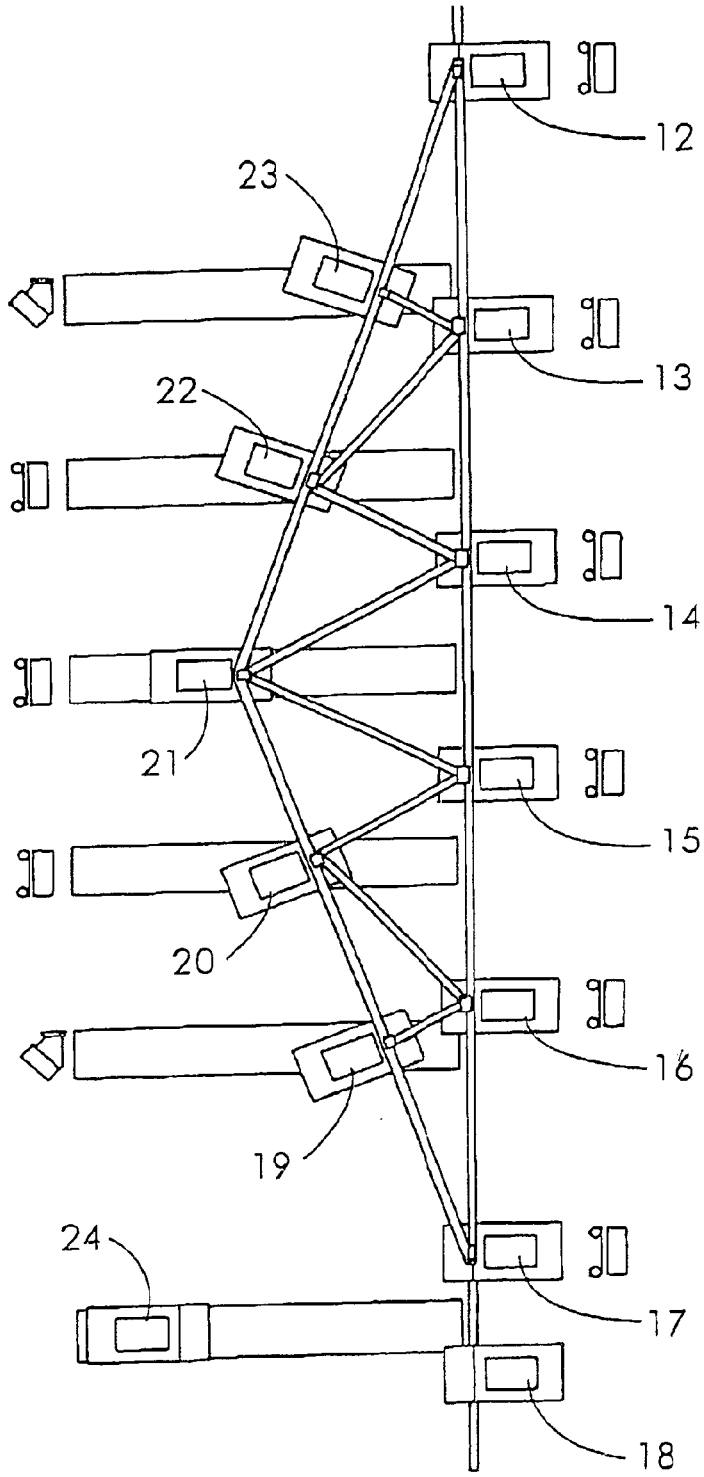
FIG. 2 is a schematic plan view of the truss manufacturing apparatus of FIG. 1 with a different truss being manufactured.

The truss manufacturing apparatus 10 shown in use in FIG. 1 manufacturing a truss 11, includes fourteen nail plate pressing machines 12 to 25, the machines 23 to 25 not being shown in FIG. 1. The truss has a bottom chord 27, two top chords 28 and 29 and a plurality of web members 31 to 34 which are connected by nail plates shown typically at 35 on the top side of the truss and 36 (not shown) on the bottom side.

Machines 12 to 18 are each mounted on a rail assembly 38 for forward and reverse movement in the direction of the bottom chord 27 (herein referred to as the "x" direction) while machines 19 to 22 are each mounted on separate rail assemblies shown typically at 39 for movement therealong in a direction perpendicular to the x direction (herein referred to as the "y" direction). Additionally, the rail assemblies 39 are each mounted on carriages for movement along a rail assembly 40 extending in the x direction beside rail assembly 38 and secured thereto. Thus, it can be seen that the machines 19 to 22 can be moved to any desired position in the x-y plane by movement of the rail assemblies 39 in the x direction and movement of the machines along those rail assemblies. Additionally, machines 19 to 22 have a base part 41 which rolls on the rail assembly and an upper part 41 which is adapted to pivot relative to the base part, the pivoting being caused (by a hydraulic or pneumatic actuator) mounted on the base part. Movement of each machine to a predetermined position in the x-y plane is achieved by operation of stepper motors and chains or racks and pinions depending on the particular machine in response entry of truss design data.

Figure 3:
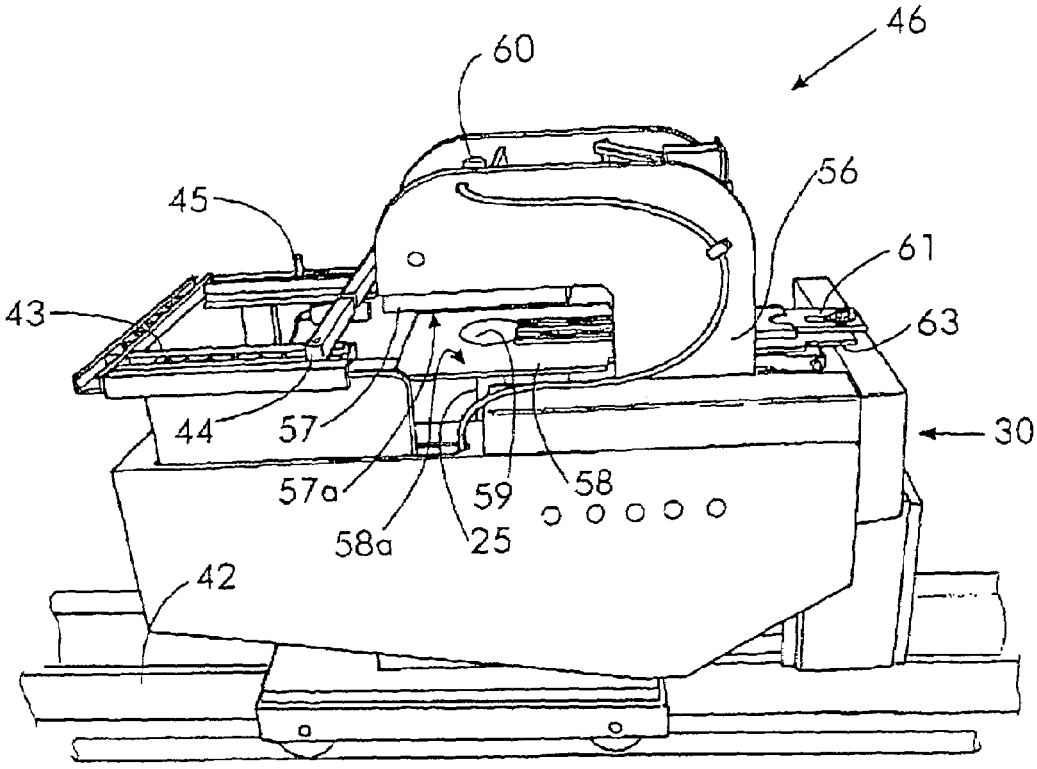
FIG. 3 is a pictorial representation of one of the nail plate pressing machines of the truss manufacturing apparatus of FIG. 1 from one side with the press head in the loading position.

As can be seen in FIG. 3, the nail plate pressing machine 22 which is typical of the other nail plate pressing machines has an open table 43 which is fixed to the machine base 41, upon which designated truss members, either the chords or the webs, can be placed in a pre-determined design position. A longitudinally extending bar 44 is secured to the table and provides a stopper against which a chord can rest to locate it in the pre-determined design position. In some machines, the bar 44 is replaced by two separate bars adapted to locate two abutting chords and for that purpose, the two stopper bars can be adjusted to a desired angle corresponding to the angle that the chords make to each other. A stopper pin 45 extends upwardly from the table to provide a stopper against which a web member can rest to locate it in the pre-determined design position, that is at the desired angle to the chord and abutting the chord at the desired position along its length. A machine at the other end of the web provides a similar stopper pin so that both ends of the web member can be properly located.

Figure 5:
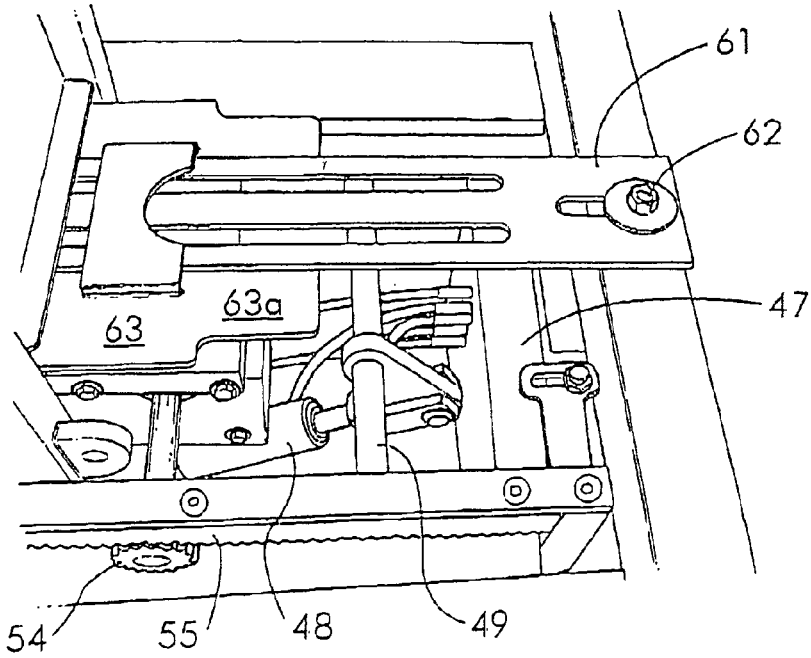
FIG. 5 is another pictorial representation of part of the nail plate pressing machine of FIG. 3 with the cover removed and the press head in a pressing position.

A press head 46 is mounted on a bed 47 in the manner of a carriage which can be more clearly seen in FIG. 5, for movement towards and away from the truss table 43 and the bed itself is mounted on the machine base 42 for up and down movement relative thereto. The up and down movement is caused by a pneumatic ram 48 connected to a crank and linkage mechanism 49.

Figure 4:
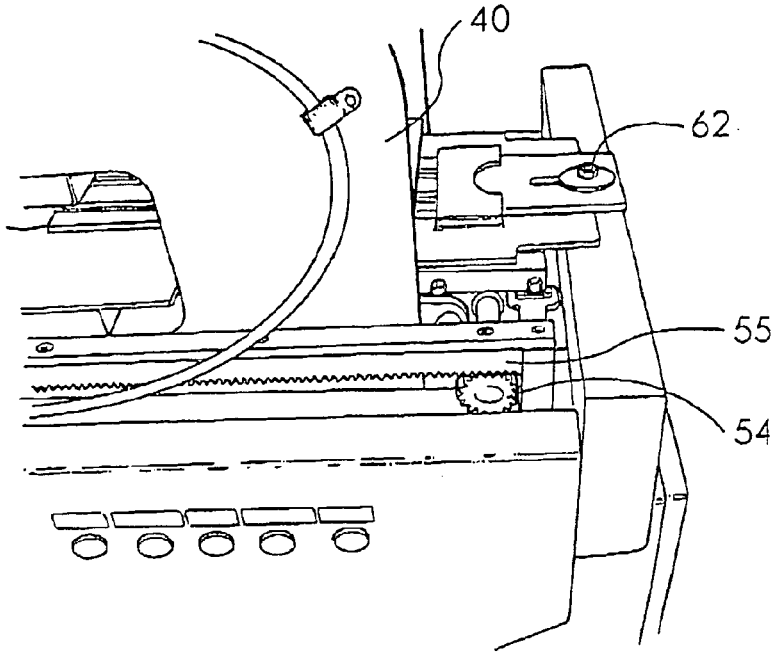
FIG. 4 is a pictorial representation of part of the nail plate pressing machine of FIG. 3 from the same side with a safety cover removed and the press head in the loading position.
Figure 6:
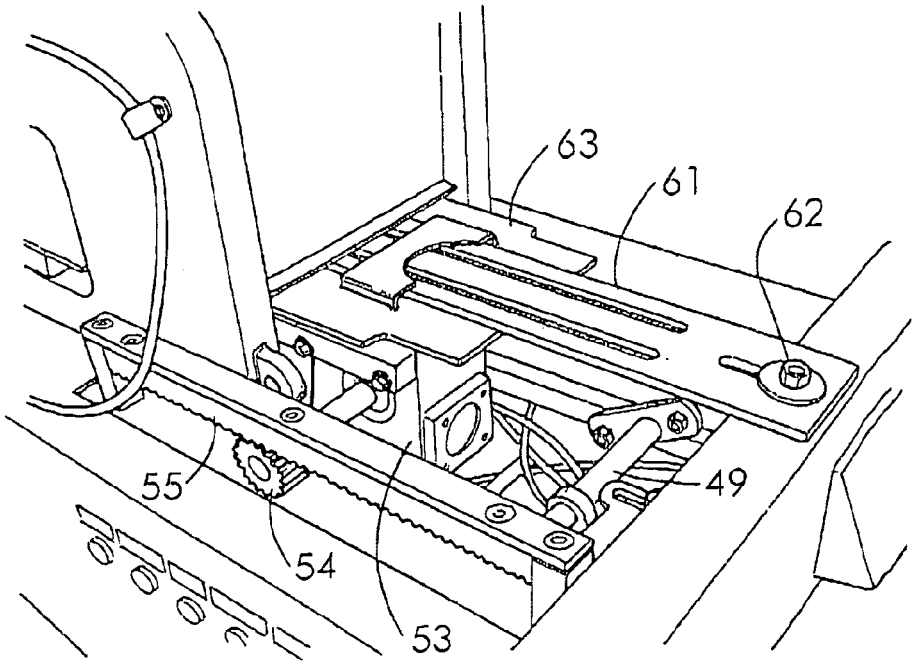
FIG. 6 is another pictorial representation of part of the nail plate pressing machine of FIG. 3 with the cover removed and the press head in the same pressing position.
Figure 7:
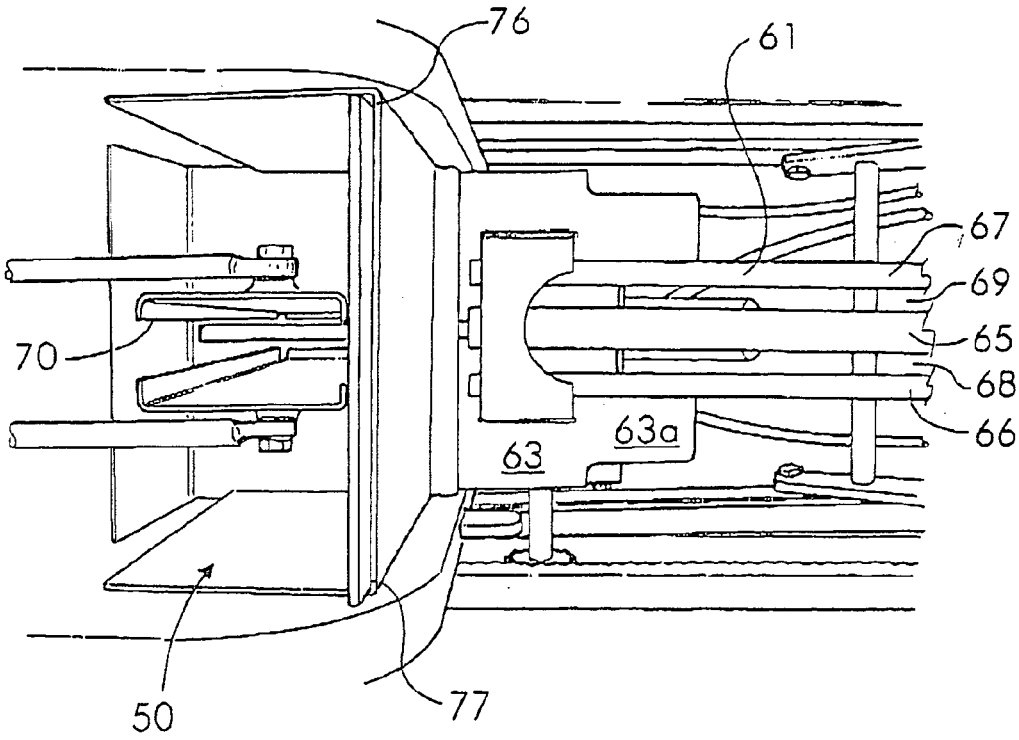
FIG. 7 is a pictorial representation of part of the nail plate pressing machine of FIG. 3 from above with the cover removed and the press head in a different pressing position.
Figure 8:
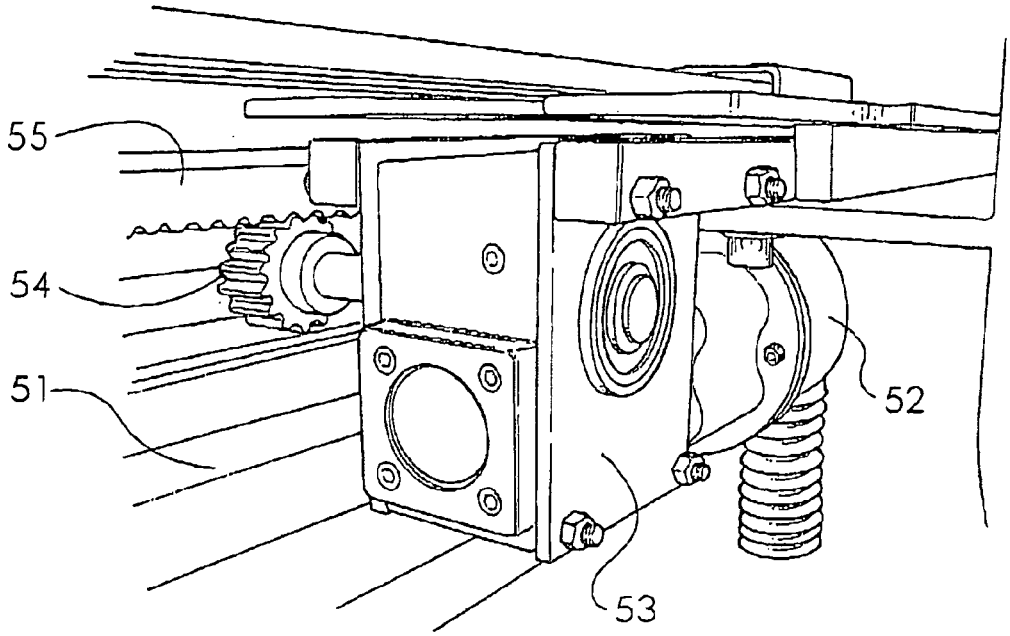
FIG. 8 is a pictorial representation of part of the nail plate pressing machine of FIG. 3 showing part of the drive mechanism.
Figure 9:
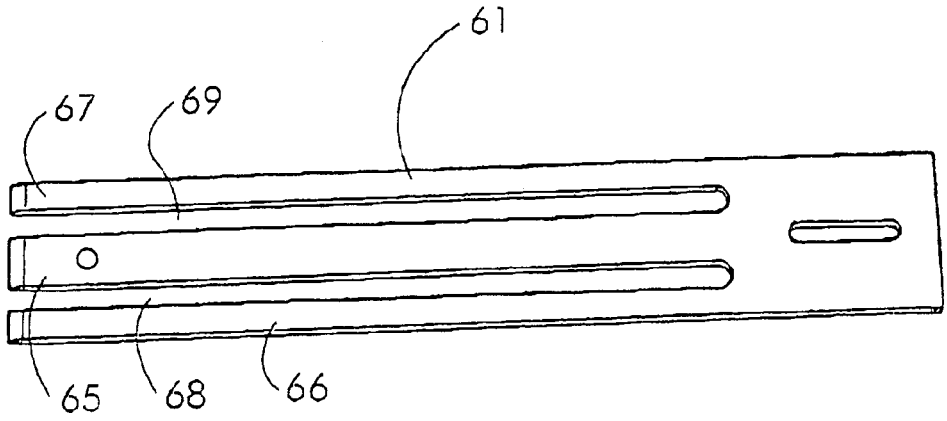
FIG. 9 is a pictorial representation of a pusher bar of the nail plate pressing machine of FIG. 3.

As can be more clearly seen in FIG. 8, the bed has opposed rails 51 (only one side shown) on which the press head travels towards and away from the table. The forward and reverse travel is driven by a stepper motor 52 which is connected to a gear box 53 which in turn drives a pinion 54 along a rack 55 which runs above the rail 51 as can be seen more clearly in FIGS. 4, 5 and 6. Rotation of the stepper motor is controlled by a computer program as will be described more fully later.

The press head assembly has a generally U-shaped plate steel frame 56 with the mouth of the U being defined by an upper press plate 57 having a downwardly facing press face 57*a* and a lower press plate 58 having an upwardly facing press face 58*a* which are adapted to press nail plates into the upper and lower faces of the truss members to be connected respectively. The lower press plate is mounted to the press frame 56 for up and down movement relative thereto under the action of a hydraulic ram 25 (not visible in the drawings) mounted under the lower press plate and of known form.

As can be seen in FIG. 3, the bottom plate has a magnetic centre piece 59 which is adapted to hold a nail plate in a pre-determined position on the bottom press plate. Similarly, the upper press plate has a magnetic centre piece (not shown) but that centre piece is connected to the lower end of a pneumatic ram 60 for up and down movement towards and away from the magnetic centre piece 59 whereby a nail plate can be picked up by the upper magnetic centre piece from the lower press plate as will be explained more fully later.

A pusher bar 61 is slidably mounted on the press head assembly so that the press head can move forward and backwards relative thereto for feeding nail plate cartridges to the lower press plate 58 from a magazine 70 which is releasably mounted in a chamber 50 formed in the press head frame 56 with the bottom of the chamber being defined by a loading plate 63 which is contiguous with the bottom press plate and has an upper face 63*a* in the same plane as the lower press face 58*a* and the pusher is arranged to slide on that face. The pusher is connected to the bed 47 by a bolt 62 which is allowed to move up and down relative to the bed with the press head but prevents forward and reverse movement with the press head. Each nail plate cartridge comprises two opposed nail plates nested together.

Figure 10:
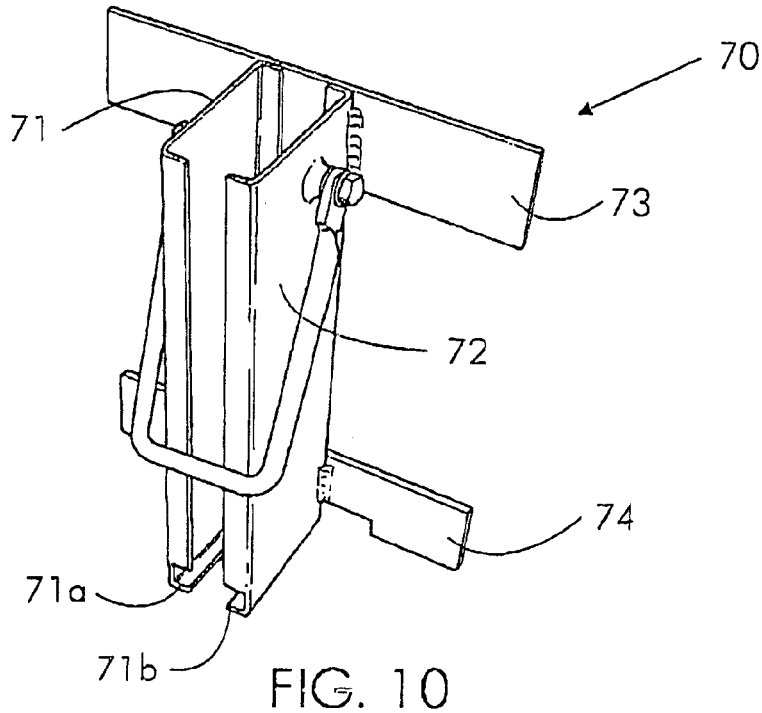
FIGS. 10 and 11 are pictorial representations of different sized magazines for use in the nail plate pressing machine of FIG. 3.
Figure 11:
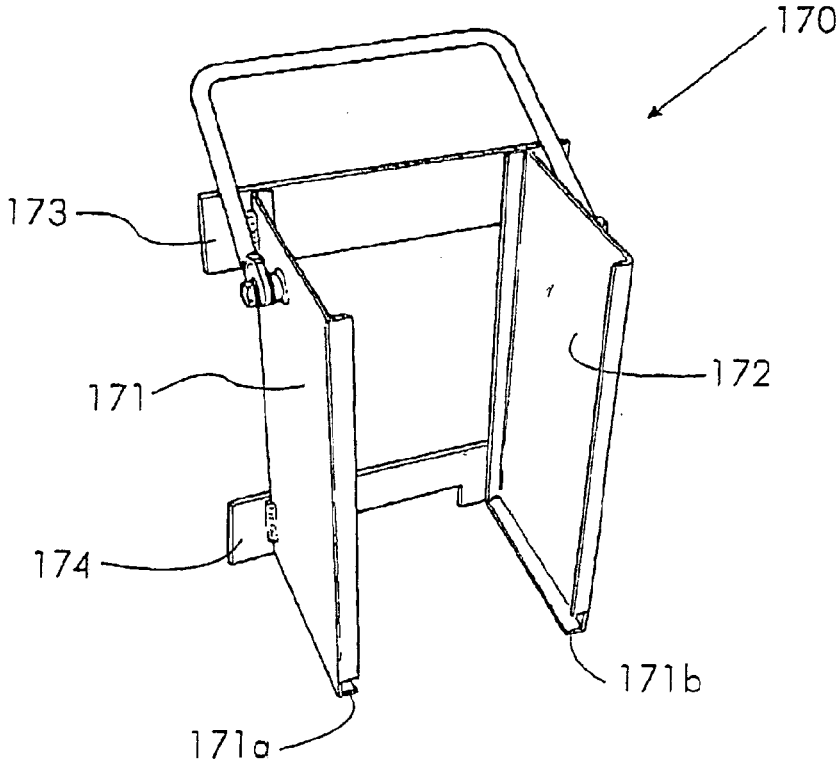

As can be seen in FIG. 10, the magazine 70 has two opposed side walls 71 and 72 which have inwardly directed lips 71*a* and 71*b* respectively at their lower ends which are adapted to a stack of cartridges in the magazine. Similarly, wider magazine 170 has similar features which are referenced by the same numbers but prefaced by a "1". The lips are adapted to rest on the loading plate so that the bottom cartridge in the magazine is immediately adjacent the loading plate ready for loading. The magazine has two spaced apart securing bars 73 and 74 which are adapted to slide into opposed slots 76 and 77 in the magazine chamber 50 so as to secure the magazine therein. The lower securing bar 74 is spaced from the lips 71*a* and 71*b* by a distance slightly greater than the thickness of a nail plate cartridge so that the pusher can slide under that securing bar to push a cartridge forwards form the magazine.

Advantageously, the chamber is adapted to receive any one of a number of different sized magazines, one for each sized nail plate and the complementary slots and securing bars provide for easy changeover from one magazine to another. Also of great advantage is that the arrangement of the magazine in the chamber with the slots and securing plates at the rear allow all magazines to be fitted to the chamber in the same manner with the rear edge of the cartridges in the same vertical plane irrespective of which magazine and which cartridges are loaded into the chamber.

As can be seen in FIG. 8, the pusher bar has a centre finger portion 65 and two side finger portions 66 and 67 spaced on opposite sides of the centre finger portion to define two longitudinally extending slots 68 and 69 which are adapted to slidably receive therein the magazine side walls 71 and 72 of the narrow magazine. However, when used with the larger magazine all three fingers fit between the side walls 171 and 172. Thus, the same pusher 61 can cooperate with a narrow magazine or a wide magazine.

In use, a magazine containing selected nail plates is loaded into the chamber 50 of each machine. Different machines may have different magazines loaded depending on the size of the truss members at a particular joint and the size of nail plate required by the truss design for each joint. Firstly, the machines move to respective predetermined positions along the various rail assemblies by operation of the various motors in response to computer generated pulses controlled by the truss design data. An operator (or a number of operators) then place the truss members in the predetermined positions to form the truss with the locating bars and pins locating and holding the various members in their respective positions ready for the nail plates to be pressed in the predetermined securing positions to connect the truss members together.

In order to load a nail plate cartridge from a magazine on to the lower press head, the computer program causes the press head to move forward by operation of the stepper motor so that the forward end of the pusher 61 is located behind the magazine whereupon a cartridge can drop on to the lips 71*a* and 71*b* of the magazine and thus having its rear edge in line with the forward end of the pusher. The press head then moves rearwards by operation of the stepper motor under the control of the computer such that the press head slides relative to the pusher and the cartridge is pushed on to the magnetic centre piece of the bottom press plate. The stepper motor is controlled to position the cartridge with its outside edge (that is the edge closest to the outside edge of the truss chord to which it is to be fitted) in the same pre-set position all the time irrespective of the size of the nail plates being used. The pneumatic ram 59 then lowers the magnetic centre piece of the upper press plate on to the cartridge and lifts the top nail plate thus separating the cartridge as it retracts upwardly to hold the top nail plate against the upper press plate in opposed relation to the lower nail plate which is held in position by the bottom centre piece. The press head and the bed on which it is mounted are then raised by operation of the pneumatic or hydraulic ram 48 so that the upper press head with the attached nail plate can clear the upper face of the locator bar 44 and the truss member (or members) which are located thereagainst or against the locating pin 45 as the press head moves forward. The computer then causes the stepper motor to rotate thereby moving the press head forward to a pre-determined pressing position with the nail plates above and below the pre-determined securing position on the pertinent truss members whereupon the hydraulic ram 25 moves upwards to force the bottom press plate upwards to engage with the lower face of the truss member and simultaneously forces the upper press plate downwards overriding the pneumatic ram 48 so as to press the two nail plates into the predetermined securing position to connect the truss members together in much the same manner as a G-clamp. Upon completion of the pressing operation the hydraulic ram pressure is released. The computer then causes the stepper motor to move the press head forward-so as to position it realtive to the pusher for loading the next cartridge for the next truss.

As briefly mentioned above, operation of the stepper motor is controlled by computer which reads the desired securing position of the nail plates from computerised design data for the particular truss being manufactured. That data sets the securing position by relative to the outside edge of the truss member, say the top chord in this case, which is located against the locating bar 44. The stepper motor and the press head are calibrated by reference to the forward face of the locating bar against which the truss member is located. Thus, the computer controls the movement of the stepper motor and thus the press head to the pre-determined securing position by reference to the locating bar which in turn is a reference point for the outside edge of the truss. Advantageously, irrespective of what sized truss member is located against the locating bar, the reference point for the press head remains the same and nail plates can be secured to the truss members in the desired pre-determined design positions because the press head is calibrated by reference to the position of the locating bar.

Advantageously, the magazines are mounted in the chamber 55 with the rear edge of the nail plate cartridges being in the same vertical plane irrespective of which magazine or which sized cartridges are being used. Thus, the operator simply needs to change the magazine for a different truss design and the design data for that truss through the controlling computer will move the press head to the correct design position for a different nail plate.

The foregoing description has been given by way of illustrative example of the invention and many modifications and variations which will be apparent to persons skilled in the art may be made without departing from the spirit and scope of the invention as defined in the appended claims.

The invention claimed is:

1. A nail plate pressing machine for use in manufacturing timber trusses and adapted to travel in a horizontal plane to a selected machine position, the machine including:

locating means for locating two or more truss members to be connected in respective predetermined design positions;

a press head adapted for movement to a range of pressing positions for pressing a nail plate into engagement with the two or more juxtaposed truss members in a predetermined securing position to secure them in their respective predetermined design positions;

a controller for controlling movement of said press head to a selected pressing position, said controller including means for receiving design data for a truss being manufactured, means for receiving design data for a selected nail plate and means for determining the position of the outside edge of one of the juxtaposed truss members, and means for processing the design data received for the truss, the design data received for the nail plate and the position of the outside edge of the truss member determined so as to select a pressing position of said press head within said range of pressing positions; and drive means for driving said press head to the selected pressing position.

2. A nail plate pressing machine according to claim 1, wherein the position of the outside edge of one of the truss members is assumed by reference to the locating means.

3. A nail plate pressing machine according to claim 1, wherein said drive means includes a stepper motor and a rack and pinion adapted to move said press head forwards and backwards.

4. A nail plate pressing machine according to claim 3, wherein said drive means includes lifting means adapted to raise and lower said press head.

5. A nail plate pressing machine according to claim 1, wherein said press head has a first face adapted to engage with one face of the truss members to be connected and a second opposed face spaced from said first face and adapted to engage with the other face of the truss members to be connected and said first and second faces are adapted to cooperate to press nail plates into said first and second faces of the truss members respectively.

6. A nail plate pressing machine according to claim 1, including a magazine adapted to contain nail plates for pressing to engagement with the two or more truss members in the predetermined securing position.

7. A nail plate pressing machine according to claim 6, including a pusher adapted to push a nail plate or cartridge comprising an opposed pair of nail plates from said magazine.

8. A nail plate pressing machine according to claim 7, wherein said pusher is adapted to cooperate with any one of a plurality of different sized magazines adapted to hold different sized nail plates or different sized nail plates.

9. A nail plate pressing machine according to claim 8, wherein each one of said plurality of magazines has two spaced apart side walls adapted to retain a stack of nail plates there between and a lip, lug or similar shaped elements extending therefrom and adapted to support thereon the stack of nail plates.

10. A nail plate pressing machine according to claim 9, wherein said pusher is adapted to engage with the nail plate or nail plate cartridge resting against said lips or lugs and push it from said magazine.

11. A nail plate pressing machine according to claim 10, wherein said pusher includes a first finger portion adapted to slide between said lips or lugs and a pair of second finger portions spaced from said first finger portion on opposite sides thereof to form spaced apart slots.

12. Truss manufacturing apparatus for use in manufacturing timber trusses, including:

a plurality of nail plate pressing machines according to claim 1 arranged for relative movement to each other in horizontal plane.

13. A nail plate pressing machine for use in manufacturing timber trusses and adapted to travel in a horizontal plane to a selected position, including:

locating means for locating two or more truss members to be connected in respective predetermined design positions;

a press head adapted for movement from a pre-pressing position in which the one or more nail plates may be loaded for pressing to a range of pressing positions in which the one or more loaded nail plates may be pressed into engagement with the two or more adjacent truss members in a predetermined securing position and vice versa, and securing means on said press head adapted to secure any one of a plurality of magazines within a range of magazines sizes, each magazine being adapted to hold a plurality of nail plates a or plurality of nail plate cartridges of a predetermined size respectively for loading, said securing means being adapted to secure each sized magazine in a position in which a selected edge of a nail plate or a nail plate cartridge to be loaded is in a predetermined loading position irrespective of the magazine selected;

nail plate loading means for loading a nail plate or a nail plate cartridge from said magazine;

drive means for driving said press head from said pre-pressing position to said pressing position and vice versa;

a controller for controlling movement of said press head from said pre-pressing position to said selected pressing position and vice versa;

actuating means for actuating said press head to press a loaded nail plate into engagement with the two or more truss members in the securing position; and wherein said nail plate loading means includes a pusher adapted to push a nail plate or cartridge comprising an opposed pair of nail plates from said magazine and is adapted to cooperate with any one of a plurality of different sized magazines secured to said press head and said pusher is adapted to push a nail plate or a nail plate cartridge from the magazine upon movement of said press head from the pressing position to the pre-pressing position.

14. A nail plate pressing machine according to claim 13, wherein each one of said plurality of magazines has two spaced apart side walls adapted to retain a of nail plates there between and a lip, or lug extending therefrom and adapted to support thereon the stack of nail plates.

15. A nail pressing machine according to claim 14, wherein said pusher is adapted to engage with a nail plate or nail plate cartridge resting against said lips or lugs and push the nail plate or nail plate cartridge from said magazine.

16. A nail plate pressing machine according to claim 14 or claim 15, wherein said pusher includes a first finger portion adapted to slide between said lips or lugs and a pair of second finger portions spaced from said first finger portion on opposite sides thereof to form spaced apart slots.

17. A nail plate pressing machine according to claim 13, wherein said drive means includes a stepper motor and a rack and pinion.

18. A nail plate pressing machine according to claim 17, wherein rotation of said stepper motor is dependent on data relating to the design of the truss to be manufactured.

* * * * *